United States Patent [19]

Niemeyer et al.

[11] Patent Number: 4,486,632

[45] Date of Patent: Dec. 4, 1984

[54] HIGH-VOLTAGE POWER SWITCH

[75] Inventors: Lutz Niemeyer, Birr; Blaise Perrenoud, La Neuveville; Klaus Ragaller; Ekkehard Schade, both of Wettingen; Rolf Schaumann, Hüttikon, all of Switzerland

[73] Assignee: BBC Brown, Boveri & Company, Limited, Baden, Switzerland

[21] Appl. No.: 387,465

[22] Filed: Jun. 11, 1982

[30] Foreign Application Priority Data

Jun. 12, 1981 [CH] Switzerland ..... 3860/81

[51] Int. Cl.[3] ..... H01H 33/88

[52] U.S. Cl. ..... 200/148 A; 200/150 G

[58] Field of Search ..... 200/148 A, 150 G, 148 R

[56] References Cited

U.S. PATENT DOCUMENTS 2,442,010 5/1948 Leeds et al. ..... 200/150 G

*Primary Examiner*—Robert S. Macon

*Attorney, Agent, or Firm*—Burns, Doane, Swecker & Mathis

[57] ABSTRACT

In a high-voltage power switch having a movable contact and at least one other contact, wherein the contacts define a quenching path in which an arc burns, a piston/cylinder compression device in which fresh quenching gas is condensed, and a heating volume in which quenching gas is stored and compressed by the arc as a result of heating, quenching gas compressed during a switching process is blown into the quenching path and removed through a nozzle into an expansion space. So that the blowing of the arc is nearly independent of the intensity of the current to be interrupted and, in addition, an increase in the quenching capacity can be attained by means of a supply of fresh quenching gas, the movable contact is rigidly connected to the piston, which changes the volume of a compression space. The compression space and the heating volume open into a common annular duct. This annular duct is a part of a mixing device for hot and cold quenching gas and connects the compression space and the heating volume to the quenching path.

3 Claims, 3 Drawing Figures

HIGH-VOLTAGE POWER SWITCH

Figure 1:
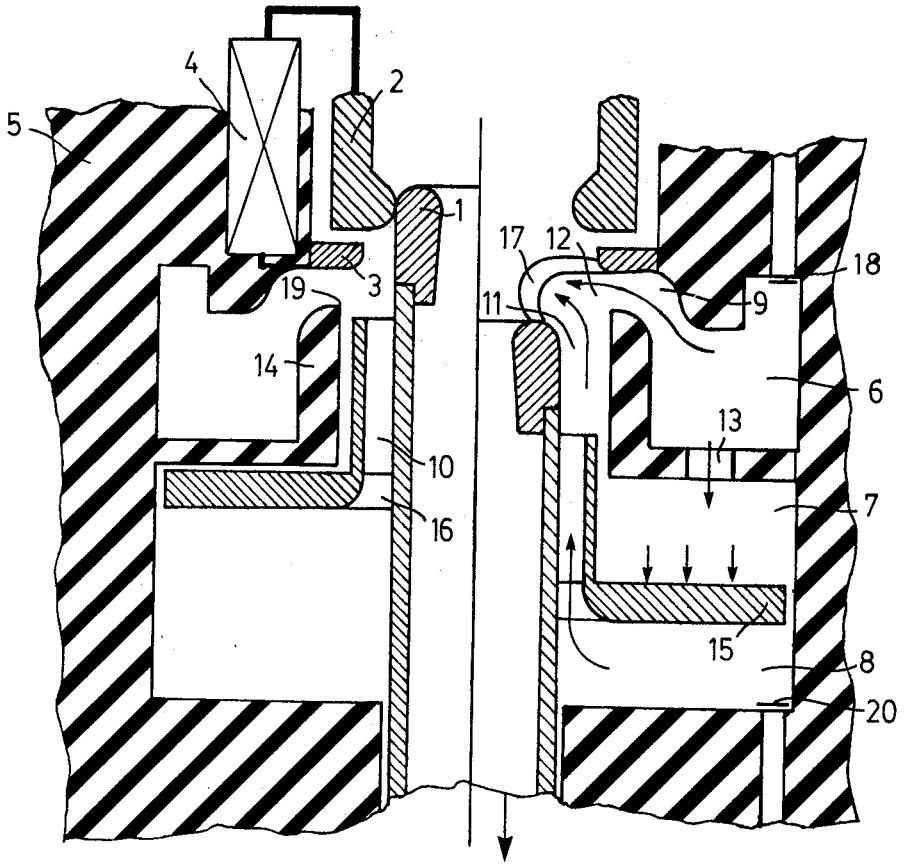

The invention relates to a high-voltage power switch of the type having a piston attached to a movable contact to compress quenching gas during a circuit breaking operation.

Such a switch has been disclosed in German Offenlegungsschrift No. 2,741,022 and in particular FIG. 8. In this switch, the quenching gas located in a closed chamber is in principle heated by a rotating arc as a result of the action of a magnetic field, and is condensed. With high breaking currents, the gas pressure in the heating chamber rises steeply and above a predetermined pressure value a wall defining the heating chamber is moved into another closed chamber. This caused fresh quenching gas located in this chamber to be compressed and then to be used for quenching the switching arc. In the case of this switch, hot quenching gas is exclusively supplied at least in the initial phase of the quenching process. In addition, the intensity of the quenching gas blowing action is a function of the intensity of the current to be switched off.

It is the object of the invention to further develop a switch of this basic type in such a manner that the blowing onto the arc is nearly independent of the intensity of the current to be switched off and that the supply of fresh quenching gas is provided at the beginning of the quenching process.

This object is achieved by rigidly connecting the movable contact to a member that changes the volume of a compression space, and by having the compression space and the heating volume open into an annular duct, which connects them to the quenching path. The power switch according to the invention is characterised by the feature that even if weak currents are switched which result in only a relatively low increse in pressure, a quenching gas flow is available which is sufficiently strong to quench the switching arc. This quenching gas flow is in addition characterised by the feature that it contains a relatively great proportion of fresh quenching gas in all cases.

The quenching capacity of the high-voltage power switch according to the invention can be effectively improved further by constructing the switch so that the openings of the compression space and the heating volume into the annular duct are separated by an annular wall that projects into the annular duct. In this embodiment the temperature of the heated quenching gases is reduced in a particularly favorable manner by mixing in fresh quenching gas.

In order to obtain good switching capacities for low and high currents with a switch having a part of insulating material which is constructed as a nozzle, it is recommended to construct the switch so that the annular duct is defined by the movable contact and an insulating member connected to the movable contact.

As a further feature of the invention, the switch is constructed so that the piston divides the compression space into two annular spaces of complementary changeable volumes that are respectively connected to the annular duct and the heating volume. With this arrangement, the propulsion of the moveable switching part is supported in the direction of propelling by the heated quenching gases.

This propulsion support is nearly optimum if the power switch of the invention is constructed with a differential piston having a greater surface area associated with the heating volume.

Figure 2:
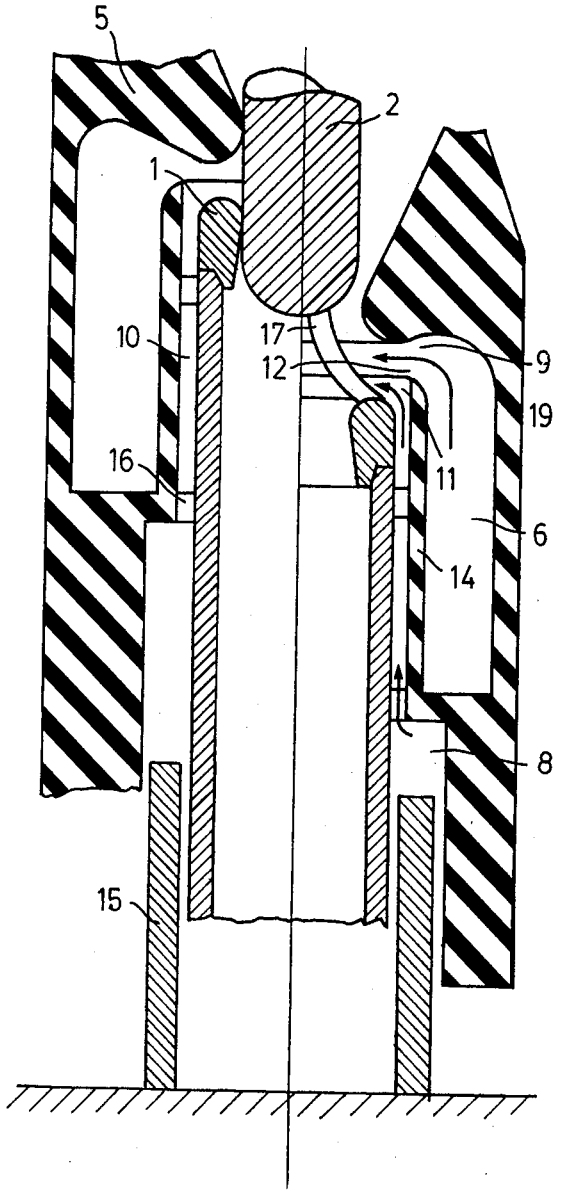
Figure 3:
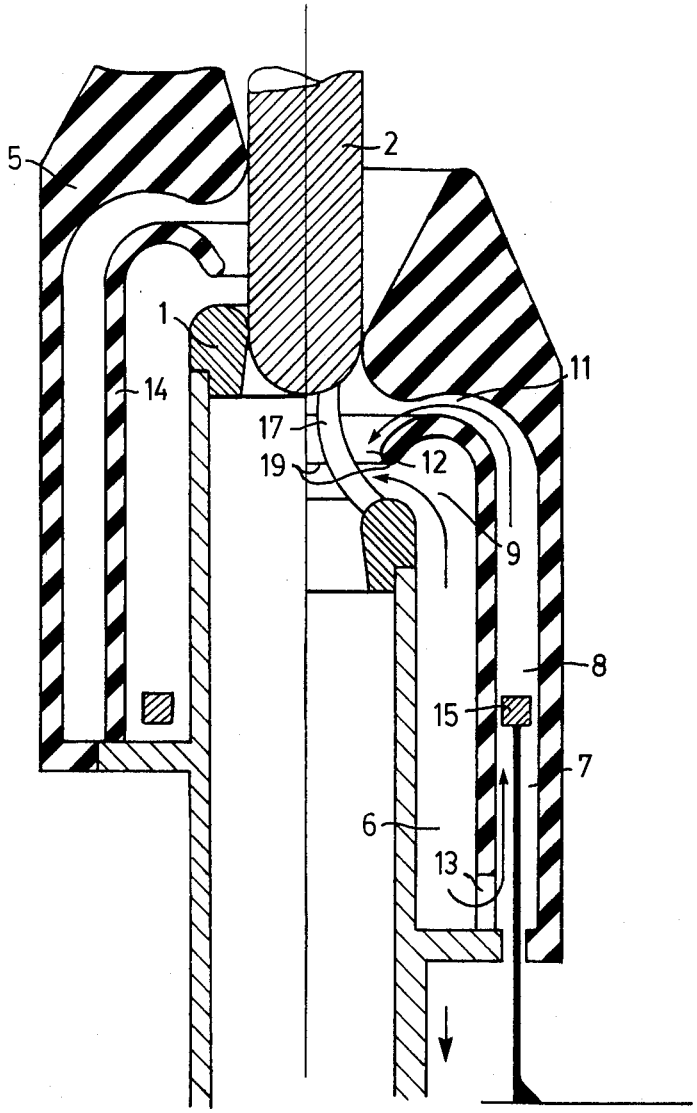

In the text which follows, illustrative embodiments of the invention are represented in a simplified form with the aid of the drawing, in which:

FIG. 1 shows a top view of a section through a first embodiment of the high-voltage power switch of the invention, FIG. 2 shows a top view of a section through a second embodiment of the high-voltage power switch of the invention, and FIG. 3 shows a top view of a section through a third embodiment of the high-voltage power switch of the invention.

In all figures, the respective high-voltage power switch is shown in the switching-on position on the left-hand side and in each case in a switching-off phase of the respective high-voltage power switch on the right-hand side. In addition, identical parts have been provided with the same reference symbols in all figures.

FIG. 1 shows a top view of a section through the contact arrangement of a high-voltage power switch according to the invention. A movable burn-off contact part 1, constructed as a nozzle tube, engages the contact fingers of a fixed burn-off contact part 2 (see left-hand side). Underneath the fixed burn-off contact part 2 an annular electrode 3 is disposed which is electrically conductively connected to one end of a coil 4. The other end of the coil is electrically conductively connected to the burn-off contact part 2. The coil 4 is attached to a part 5 of insulating material in which annular spaces 6, 7 and 8 are provided. A further annular duct 12 is connected to the annular space 6 via an annular opening 9, to the annular space 8 via an annular duct 10 and an annular opening 11. The annular spaces 6 and 7 are connected to each other via an opening 13 provided in a wall 14. The annular spaces 7 and 8 are separated from each other by means of a ring piston 15. This ring piston 15 is connected via webs 16 to the movable burn-off contact part 1 and is a part of a compression device for quenching gas which is provided in the described spaces and ducts. Non-return valves 20 are provided in the annular space 8 to prevent a pressure decrease in the space 8 in the event of the compression device being actuated and to enable fresh quenching gas to flow in the conducting mode.

The operation of the high-voltage power switch of the invention, according to FIG. 1, is as follows:

Upon actuating the switch the burn-off contact part 1 is moved downwards. At the same time, the piston 15 of the compression device also moves downward and compressed quenching gas located in the annular space 8, the non-return valves 18 preventing the pressure from decreasing in the spaces 6 and 7. As soon as the burn-off contact parts 1 and 2 have separated from each other, an arc 17 will form between them. With increasing distance between the burn-off contact parts 1 and 2, the root of the arc 17 moves from the fixed burn-off contact part 2 to the ring electrode 3 and while doing so energizes the coil 4, through which the breaking current now flows, (see right-hand side of FIG. 1). The magnetic field of the coil causes the switching arc 17 to rotate about the axis of the switching part. While this is happening quenching gas is greatly heated in the high-current phase which simultaneously causes the pressure of the quenching gas to increase.

The heated quenching gas, which is under high pressure, is stored in the annular space 6. A part of the quenching gas stored in the annular space 6 reaches, via the opening 13, the annular space 7 in which it exerts on the piston 15 a force acting in the breaking direction and thus supporting the switch drive. This prevents the piston 15 from working against the pressure increase of the quenching gas, caused by heating, and thus resulting in a breaking of the drive.

Simultaneously, the fresh quenching gas located in the annular space 8 is compressed and, when the heating effect of the arc 17 decreases on approaching the zero transition of the current flows via the annular duct 10, in the direction indicated by arrows to the annular duct 12 and there mixes with the heated quenching gas which now also flows out of the annular space 6. The mixing of the fresh and the hot quenching gas is further supported by the fact that the annular spaces 6 and 8 are separated from each other by the annular wall 14 which has an edge 19 which projects into the annular duct 12. The edge 19 gives rise to a turbulent boundary layer between the fresh and the hot quenching gas and thus promotes their mixing.

From the annular duct 12, the quenching gas, which is under high pressure but has been considerably cooled, is fed into the quenching path located between the moveable switching part 1 and the ring electrode 3 where it particularly effectively blows onto the arc far past the zero transition of the current and subsequently reaches an expansion space via the nozzle-shaped opening of the burn-off contact part 1.

FIG. 2 shows another illustrative embodiment of the switch according to the invention.

In contrast to FIG. 1, this figure shows a top view of a section through the contact arrangement of a switch in which the heating of the quenching gas is effected not by a rotating arc but by an arc drawn between the movable switching part 1 and a solid contact part 2. In this case, the part 5 of insulating material is constructed as a nozzle. Compared with the dimensions of the annular space 6 that defines a heating volume, the piston 15 has a small cross-section so that during the compression of fresh quenching gas in the annular space 8 no drive braking will be caused as a result of the great increase in pressure in the high-current phase when high currents are being switched. Shortly before the zero transition of the current is reached, the fresh and the heated quenching gas are mixed in the annular duct 12 and, as a result of the presence of two nozzles, that is to say nozzle 5 and the hollow contact part 1 constructed in the space of a nozzle, the arc 17 is subjected to a double blowing action.

The embodiment, of the high-voltage power switch of the invention shown in FIG. 3, essentially corresponds to the embodiment of FIG. 2 but, like the switch of FIG. 1, is provided with a piston 15, of which the surface turned away from the annular space 8 again defines the annular space 7 connected to the heating volume 6 for the purpose of supporting the drive. In this embodiment of the high-voltage power switch according to the invention it has been shown to be particularly advantageous to construct the piston 15 in such a manner that this area is the larger area of a differential piston.

We claim:

1. A gas-filled high-voltage switch comprising:

first and second relatively movable contacts that define a quenching path in which an arc burns during a current-breaking operation;

a compression device having a piston connected to one of said contacts for compressing quenching gas in a compression space during a current-breaking operation;

a heating volume in which quenching gas is heated and pressurized by the heat from an arc in said quenching path;

an annular duct defined by one of said contacts and an insulating member connected to said one contact, said annular duct connecting each of said compression space and said heating volume with said quenching path such that compressed quenching gas from said space is mixed with heated quenching gas from said volume in said annular duct; and an annular wall separating the openings of said compression space and said heating volume and having an edge that projects into said annular duct.

2. A high voltage power switch comprising:

first and second relatively movable contacts that define a quenching path in which an arc burns during a current-breaking operation;

a compression device having a piston connected to one of said contacts for compressing quencing gas in a compression space during a current-breaking operation, said compression space being divided by said piston into two annular spaces having complementary volumes;

a heating volume in which quenching gas is heated and pressurized by the heat from an arc in said quenching path, one of said annular spaces being connected to the heating volume; and an annular duct connecting the other of said annular spaces and said heating volume with said quenching path such that compressed quenching gas from said other annular space is mixed with heated quenching gas from said volume.

3. The high-voltage power switch of claim 2, wherein said piston is a differential piston, the greater piston area of which defines said other space that is connected to the heating volume.

* * * * *